US009540952B2

(12) United States Patent
Miller et al.

(10) Patent No.: US 9,540,952 B2
(45) Date of Patent: Jan. 10, 2017

(54) TURBOCHARGER WITH OIL-FREE HYDROSTATIC BEARING

(71) Applicants: Timothy J Miller, Jupiter, FL (US); Alex Pinera, Jupiter, FL (US)

(72) Inventors: Timothy J Miller, Jupiter, FL (US); Alex Pinera, Jupiter, FL (US)

(73) Assignee: S & J DESIGN, LLC, Jupiter, FL (US)

( * ) Notice: Subject to any disclaimer, the term of this patent is extended or adjusted under 35 U.S.C. 154(b) by 306 days.

(21) Appl. No.: 14/245,199

(22) Filed: Apr. 4, 2014

(65) Prior Publication Data

US 2016/0333737 A1 Nov. 17, 2016

Related U.S. Application Data

(60) Provisional application No. 61/881,667, filed on Sep. 24, 2013.

(51) Int. Cl.
*F01D 25/22* (2006.01)
*F02B 37/04* (2006.01)

(52) U.S. Cl.
CPC ..... *F01D 25/22* (2013.01); *F02B 37/04* (2013.01)

(58) Field of Classification Search
CPC ..... F16C 2360/24; F16C 32/0662; F16C 32/0681; F16C 32/0603; F16C 32/0696; F02B 37/04; F01D 25/22; F01D 5/284; F01D 25/125; F01D 25/16; F01D 25/162; F01D 25/164; F01D 25/166; F01D 25/168; F05D 2220/40; F05D 2240/53; F04D 25/04; F04D 25/045; F02C 6/12
USPC ..... 417/405, 406, 407; 415/110, 111, 175; 384/107
See application file for complete search history.

(56) References Cited

U.S. PATENT DOCUMENTS

| | | | | |
|---|---|---|---|---|
| 3,038,318 | A | 6/1962 | Hanny | |
| 3,740,163 | A | 6/1973 | Schinnerer et al. | |
| 3,799,628 | A * | 3/1974 | Van Gaasbeek | F04B 1/2042 384/12 |
| 3,828,610 | A | 8/1974 | Swearingen | |
| 4,786,238 | A * | 11/1988 | Glaser | F01D 25/125 415/175 |
| 4,848,932 | A | 7/1989 | Puetz | |
| 5,102,305 | A | 4/1992 | Bescoby et al. | |
| 5,588,325 | A * | 12/1996 | Green | F02B 67/06 123/198 C |
| 6,960,840 | B2 * | 11/2005 | Willis | F02C 3/22 290/40 A |
| 8,172,503 | B2 | 5/2012 | Sandstede et al. | |
| 8,397,506 | B1 * | 3/2013 | Wright | F01K 7/32 415/110 |
| 8,973,361 | B2 * | 3/2015 | Shimizu | F01D 11/04 123/559.1 |

(Continued)

FOREIGN PATENT DOCUMENTS

| | | | | |
|---|---|---|---|---|
| JP | WO 2012002161 A1 * | 1/2012 | | F01D 11/04 |
| WO | WO 0204827 * | 1/2002 | | F16C 32/0696 |

*Primary Examiner* — Theodore Stigell
*Assistant Examiner* — Jon Hoffmann
(74) *Attorney, Agent, or Firm* — John Ryznic

(57) ABSTRACT

A turbocharger for an internal combustion engine, the turbocharger being supported by hydrostatic bearings in both a radial and an axial direction by a compressed air supplied from a compressor of the turbocharger and boosted in pressure by a separate boost pump to a high enough pressure to support the rotor of the turbocharger.

3 Claims, 1 Drawing Sheet

(56) References Cited

U.S. PATENT DOCUMENTS

| | | | | |
|---|---|---|---|---|
| 2002/0131656 | A1* | 9/2002 | Knepper | C23C 14/025 384/110 |
| 2008/0038109 | A1* | 2/2008 | Sandstede | F01D 25/22 415/111 |
| 2008/0245323 | A1* | 10/2008 | Williamson | F01L 9/02 123/90.12 |
| 2009/0199823 | A1* | 8/2009 | Mahoney | F02C 7/222 123/497 |
| 2010/0080701 | A1* | 4/2010 | Ono | F16C 33/201 415/229 |

* cited by examiner

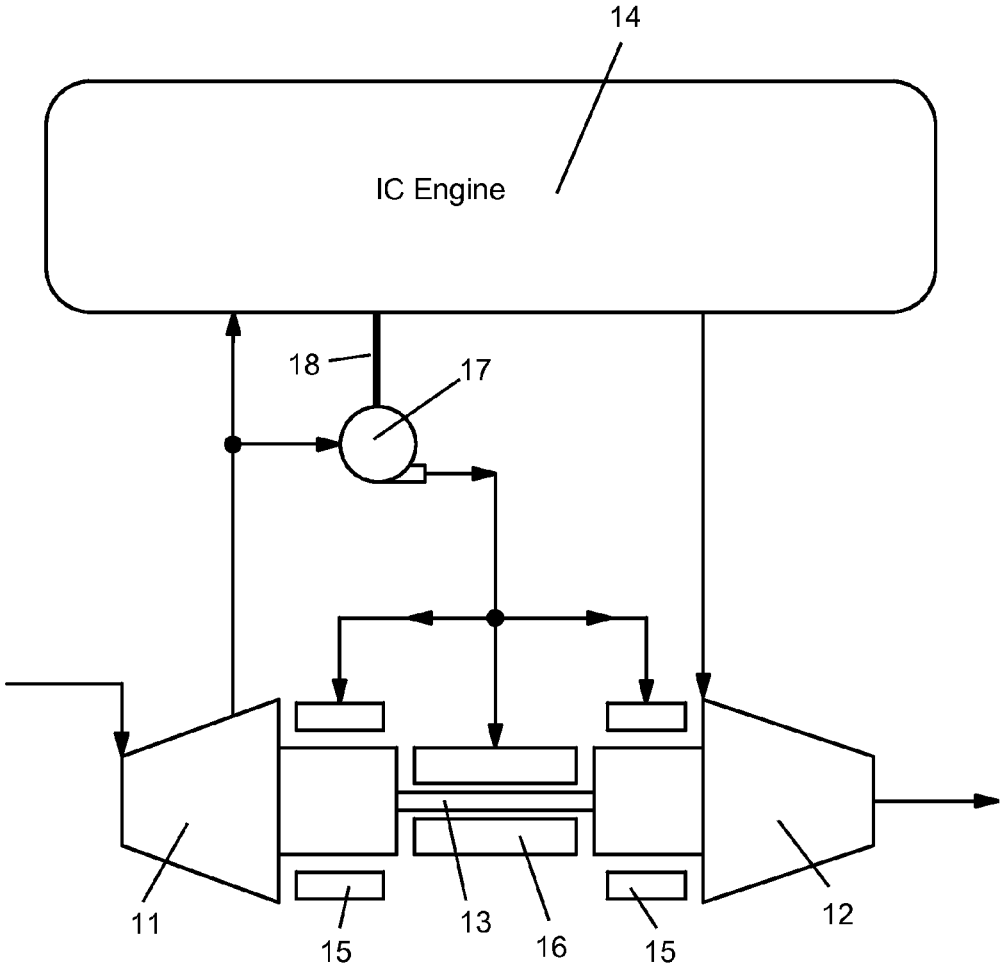
14
IC Engine
18
17
11
15
13
16
15
12

TURBOCHARGER WITH OIL-FREE HYDROSTATIC BEARING

CROSS-REFERENCE TO RELATED APPLICATIONS

This application claims the benefit to a Provisional Application 61/881,667 filed on Sep. 24, 2013 and entitled TURBOCHARGER WITH OIL-FREE HYDROSTATIC BEARING.

GOVERNMENT LICENSE RIGHTS

This invention was made with Government support under contract number FA8650-14-M-2470 awarded by the US Air Force. The Government has certain rights in the invention.

BACKGROUND OF THE INVENTION

Field of the Invention

The present invention relates generally to a turbocharger, and more specifically to a turbocharger with an oil-free hydrostatic bearing.

Description of the Related Art Including Information Disclosed Under 37 CFR 1.97 and 1.98

A turbocharger is used to compress air supplied to an engine using a hot gas exhaust as a driving force. The engine exhaust drives a turbine that drives a compressor to supply the compressed air to the engine. The performance of the engine is increased due to the compressed air.

Prior art turbochargers require shaft support systems that use oil lubricated bearings which depend on the viscosity of the fluid to provide a hydrodynamic film in the bearing. Components on the shaft typically include a compressor rotor mounted to one end of the shaft and a turbine rotor mounted to the other end of the shaft.

During operation of the turbocharger, significant radial and axial forces are produced by the compressor and the turbine which are reacted into the housing through the radial journal and axial thrust bearings. This is typically accomplished with a pressurized oil lubrication system to both remove heat and reduce rolling resistance. For a turbocharger, the lubrication system requires an oil cooler and a pump to supply sufficient pressure to the bearings while preventing the oil from coking. If oil pressure is lost or if the oil becomes contaminated from the internal combustion (IC) engine, degradation in bearing performance due to loss of lubrication or cooling occurs, leading to catastrophic failure of the turbocharger bearing system. Some advanced high temperature turbochargers utilize an additional coolant system in the bearing housing to further reduce bearing and bearing fluid temperature in order to prevent coking of the oil. A separate bearing lubrication system also adds weight to an aircraft which is critical to such aircraft as an unmanned aero vehicle or UAV.

BRIEF SUMMARY OF THE INVENTION

A turbocharger to supply compressed air to an internal combustion engine, the turbocharger includes a compressor driven by a turbine and a rotor supported by hydrostatic bearings in a radial and an axial direction. Compressed air from the compressor is directed into a boost pump that increases the pressure for use in the hydrostatic bearings. The boost pump can be driven by a power takeoff from the IC engine or from a separate motor such as an electric motor.

The hydrostatic bearings are oil-free and without any other fluid but the compressed air from the compressor and boost pump in order to allow for higher temperature exposure and to limit overall weight of the turbocharger for use in light weight aircraft such as an unmanned aero vehicle (UAV) where weight is critical to performance.

BRIEF DESCRIPTION OF THE SEVERAL VIEWS OF THE DRAWINGS

FIG. 1 shows a cross section view of the turbocharger with oil-free hydrostatic bearings of the present invention.

DETAILED DESCRIPTION OF THE INVENTION

The present invention is a turbocharger with an oil-free hydrostatic bearing. The compressor discharge gas is used as the working fluid for the hydrostatic bearing with a boost compressor to achieve sufficient hydrostatic load capacity and damping in the bearings. The present invention improves reliability and durability by eliminating the temperature sensitive oil lubricant, the oil cooler, the oil pump and bearing housing cooling systems of the prior art turbochargers. This is accomplished by utilizing compressed gas (air) from the compressor to support the shaft hydrostatically. To reduce overall power consumption in the system, the bearing feed system is pre-boosted by the turbocharger compressor and then boosted to the required operating pressure using an oil-free positive displacement compressor that is either driven directly off of the engine through an accessory take-off or driven by a small electric motor. In either case, the total power draw is relatively small resulting in minimal impact to the IC engine performance.

FIG. 1 shows a cross section view of the turbocharger with the oil-free hydrostatic bearings. The turbocharger includes a compressor 11 and a turbine 12 connected to a common rotor 13. Radial hydrostatic bearings 15 and axial hydrostatic (or thrust) bearing 16 support the rotor 13 in both the radial and axial directions.

Hot exhaust gas from an internal combustion (IC) engine 14 is supplied to the turbine 12 that drives the compressor 11 through the rotor 13 to compress air. The compressed air is then delivered to the engine 14. Some of the compressed air from the compressor 11 is bled off and supplied to a boost compressor 17 that increases the pressure to an amount sufficient to support the rotor 13 hydrostatically.

The boost compressor 17 can be driven directly by the engine 14 through an accessory take-off 18 or driven by a separate motor such as an electric motor.

Hydrostatic fluid film bearings provide a number of advantages that make them especially useful in high speed turbocharger shaft/rotor support systems. These include the following. An ability to support large loads. Hydrostatic bearing load capacity is a function of the pressure drop across the bearing land in which the fluid pressure is acting. Load capacity does not depend on the fluid film thickness or the fluid viscosity. Provides a long life (infinite in theory) because the surfaces do not touch. The stiffness and damping coefficients are very large which provides for exact positioning and control.

Using compressed air instead of oil as the working fluid in hydrostatic bearings for a turbocharger application provides for the following advantages. It eliminates lubricant failure modes, allowing for higher turbine inlet temperature operation. It reduces the thermal stresses in the bearing housing as a result of eliminating cooling passages required to prevent the oil from overheating. With increased operating temperatures in lean burning internal combustion engines, higher temperature bearings are required to support the rotor of a turbocharger. A small aircraft such as a UAV requires bearings that can withstand higher loads from maneuvers including sustained high G turns and operations in turbulent air. Hydrostatic bearings do not require the use of advanced coatings because internal parts do not rub after bearing lift-off occurs and as a result, high temperature materials including ceramics can even be used as bearing materials. A key benefit of the hydrostatic bearing in high altitude turbocharger applications is the ability to utilize the boost pressure provided by the turbocharger compressor to pre-boost the inlet pressure of a small oil-free compressor to maximize load capacity for all turbocharger operating conditions. The bearings can be lifted off prior to or immediately upon ignition of the IC engine to enable wear-free operation over the entire operating range.

Another significant benefit provided by hydrostatic bearings is the precision tolerance control they can provide. This is especially important for maximizing efficiency in turbochargers where the small diameter unshrouded compressors and turbines require minimal clearances (both radial and axial) to reduce leakage. This precision control of the shaft with a high degree of stiffness and damping makes the hydrostatic bearing well suited for the unmanned aerial system turbocharger application.

We claim the following:

1. A turbocharger for an internal combustion engine comprising:

a compressor to compress air for burning in the internal combustion engine;

a turbine to drive the compressor using hot gas exhaust from the internal combustion engine;

a rotor connected between the compressor and the turbine of the turbocharger;

first and second hydrostatic bearings to rotatably support the rotor in a radial direction;

a boost compressor having an inlet connected to an outlet of the compressor and an outlet connected to the first and second hydrostatic bearings to support the rotor; and, the boost compressor increasing a pressure of the compressed air from the compressor to a higher pressure to support the rotor.

2. The turbocharger of claim 1, and further comprising:

the rotor includes a hydrostatic axial thrust bearing supplied with compressed air from the boost compressor.

3. The turbocharger of claim 1, and further comprising:

the boost compressor is driven by a power takeoff from the internal combustion engine.

* * * * *